US006978646B2

(12) United States Patent
Raatikainen

(10) Patent No.: US 6,978,646 B2
(45) Date of Patent: Dec. 27, 2005

(54) INSTALLATION ARRANGEMENT FOR CONTROLLING HANDLE OPERATION IN A DOOR LOCK AND A DOOR LOCK PROVIDED WITH AN INSTALLATION ARRANGEMENT OF THIS KIND

(75) Inventor: Juha Raatikainen, Joensuu (FI)

(73) Assignee: Abloy Oy, Joensuu (FI)

( * ) Notice: Subject to any disclaimer, the term of this patent is extended or adjusted under 35 U.S.C. 154(b) by 14 days.

(21) Appl. No.: 10/466,535

(22) PCT Filed: Jan. 17, 2002

(86) PCT No.: PCT/FI02/00036

§ 371 (c)(1),
(2), (4) Date: Jul. 15, 2003

(87) PCT Pub. No.: WO02/059440

PCT Pub. Date: Aug. 1, 2002

(65) Prior Publication Data

US 2004/0089040 A1 May 13, 2004

(30) Foreign Application Priority Data

Jan. 24, 2001 (FI) ..... 20010139

(51) Int. Cl.[7] ..... E05B 55/04

(52) U.S. Cl. ..... 70/472; 70/149; 70/221; 70/283; 292/169.14; 292/336.3; 292/359

(58) Field of Search ..... 70/149, 472, 221–224, 70/277–283; 292/336.3, 359, 169.15, 169.14

(56) References Cited

U.S. PATENT DOCUMENTS

| | | | | |
|---|---|---|---|---|
| 323,918 A | | 8/1885 | Crockett et al. | |
| 509,194 A | * | 11/1893 | Carty | 70/149 |
| 3,769,822 A | * | 11/1973 | Yulkowski | 70/107 |
| 4,148,092 A | * | 4/1979 | Martin | 361/172 |
| 4,390,197 A | * | 6/1983 | Butts | 292/144 |
| 4,429,556 A | | 2/1984 | Kambic | |
| 4,656,850 A | * | 4/1987 | Tabata | 70/276 |
| 4,682,799 A | * | 7/1987 | Luker | 292/169.15 |
| 4,972,694 A | * | 11/1990 | Aulbers et al. | 70/277 |
| 5,474,348 A | * | 12/1995 | Palmer et al. | 292/359 |

(Continued)

FOREIGN PATENT DOCUMENTS

EP 0 537 531 4/1993

(Continued)

*Primary Examiner*—Suzanne Dino Barrett
(74) *Attorney, Agent, or Firm*—Smith-Hill and Bedell

(57) ABSTRACT

An installation arrangement for a solenoid controlled handle operation in a door lock in which force transmission from an operation axis for a handle or the like to a follower acting on a bolt of the lock is arranged by means of a movable coupling member, which receives its guidance from a solenoid arrangement. The follower is provided with two separate torsion units which are installed on the operation axis on different sides of the follower and are turnably supported to it and which can be selectively coupled by means of said coupling member to be in force transmission connection with the follower.

10 Claims, 8 Drawing Sheets

U.S. PATENT DOCUMENTS 5,475,996 A * 12/1995 Chen ..... 70/279.1
5,640,863 A * 6/1997 Frolov ..... 70/283
5,953,942 A 9/1999 Doucet et al.
6,145,353 A * 11/2000 Doucet ..... 70/277
6,286,347 B1 * 9/2001 Frolov ..... 70/472
6,354,121 B1 * 3/2002 Frolov ..... 70/277
6,619,705 B2 * 9/2003 Dalsing ..... 292/169.14
6,622,535 B2 * 9/2003 Chiang et al. ..... 70/107
6,640,594 B1 * 11/2003 Yao ..... 70/277

FOREIGN PATENT DOCUMENTS

| | | |
|---|---|---|
| EP | 1 174 570 | 1/2002 |
| GB | 2 183 718 | 6/1987 |
| WO | 96/22438 | 7/1996 |

* cited by examiner

INSTALLATION ARRANGEMENT FOR CONTROLLING HANDLE OPERATION IN A DOOR LOCK AND A DOOR LOCK PROVIDED WITH AN INSTALLATION ARRANGEMENT OF THIS KIND

CROSS-REFERENCE TO RELATED APPLICATIONS

This is a national stage application filed under 35 USC 371 based on International Application No. PCT/FI2002/00036 filed Jan. 17, 2002, and claims priority under 36 USC 119 of Finnish Patent Application No. 20010139 filed Jan. 4, 2001.

BACKGROUND OF THE INVENTION

The invention relates to an installation arrangement for a solenoid controlled handle operation in a door lock in which force transmission from either side of the lock from an operation axis for a handle or the like to a follower acting on a bolt of the lock is arranged by means of a movable coupling member, which receives its guidance from a solenoid arrangement .

Control of a handle operation in a door lock by means of a solenoid arrangement can be accomplished in different ways depending on the application. The arrangement may for instance be such that when the solenoid is energized it allows or makes it possible the right to passage by using a handle, whereby, thus, force transmission from the handle to the bolt of the lock is coupled. Alternatively the solution may be reversed so that the arrangement allows the right to passage by using a handle when the solenoid is de-energized. The way of operation of the arrangement depends on whether stress is laid on the security of the right to passage or getting out of the locked space or on the security of the locked space as such.

In practice the arrangement is usually such that from outside the door can always be opened by means of a key operated lock mechanism of the like and from inside by means of a handle, a turning knob or the like, whereby selective coupling of the handle operation presumes at the same time a two-piece or divided shaft of operation. Depending on the location of application the arrangement can also be for instance such that the door is provided with a handle or the like on both sides whereby from one side the door can always be opened by means of a handle and from the other side only selectively depending on the situation.

Another patent application discloses a solution to a problem how the same basic parts to be installed in a lock case can be made use of for both the ways of operation so that the selection of the way of operation of a handle can be accomplished in a simple way from outside the lock case without the need to open the lock case. An installation of a door lock of this kind, however, involves also another essential selection to be made depending thereon, on which side of the door and thus the lock case of the door lock there is a need to provide a handle operation. Also in this connection there is a desire to avoid providing two separate lock cases for doors turnable in different directions.

An aim of the invention is to solve the problem presented above and to provide such an installation arrangement, by means of which a lock case may be modified in connection with installation to a door so that it can be utilized in the door independent on the intended direction of turning for opening the door. A further aim is to provide an installation arrangement by means of which the measures of modification to be made in the lock case, if needed, can be accomplished without opening the lock case in as simple and easy way as possible.

SUMMARY OF THE INVENTION

According to the invention the follower is provided with two separate torsion units which are installed on the operation axis on different sides of the follower and are turnably supported to it and which can be coupled by means of said coupling member to be in force transmission connection with the follower.

The arrangement according to the invention includes with advantage an adapting member which is arranged to be installed in a spindle aperture of either one of the torsion units to thereby prevent a spindle of the handle from directly connecting with the follower, so that the spindle of the handle is in force transmission connection with the torsion unit in question. Hereby handles with a spindle of normal length can be utilized in all cases.

In a favourable embodiment of the invention the coupling member includes two protrusions which each can be coupled to be in cooperation with a torsion unit of its own. In this case the coupling member can be moved normally under the control of the solenoid but there is no need to displace the coupling member for changing the handle operation from one side of the door to the other.

In another embodiment of the invention the coupling member includes a protrusion which has a first installation position in which it is in cooperation with a first torsion unit and a second installation position in which it is in cooperation with a second torsion unit, whereby the coupling member is movable from the first installation position to the second installation position for changing the handle operation from one side of the door lock to the other.

The coupling member is with advantage turnably journalled to the follower and arranged to be movable in the direction of the operation axis for effecting said changing of the handle operation. For this purpose the follower advantageously includes a sleeve-like member for journalling of the coupling member. In addition the follower may include a guiding member, for instance a protrusion, which normally prevents movement of the coupling member from its first installation position to its second installation position. Hereby inadvertent movement of the coupling member can easily be prevented.

In addition the coupling member includes with advantage counter surfaces for an installation tool. If the lock case of the door lock includes then an opening through which the installation tool can be taken to be in cooperation with said counter surfaces for said moving of the coupling member, said measure of installation can easily be made when needed without opening of the lock case.

A second aspect of the invention relates to a door lock, to which an installation arrangement described above is advantageously adapted and which includes a bolt, a follower for moving the bolt and an operation axis at either end of which an operation device can be installed for operation of the follower, whereby force transmission from either side of the lock to the follower is arranged by means of a movable coupling member, which receives its guidance from a solenoid arrangement or the like. The follower is provided with two separate torsion units which are installed on the operation axis on different sides of the follower and are turnably supported to it and which can be coupled by means of said coupling member to be in force transmission connection with the follower. On said operation axis on one side of the lock and the follower there is arranged to installed an operation device, for instance a key operated lock mechanism, a handle or the like, which acts directly on the follower through a spindle aperture located therein. On said operation axis on the other side of the lock and the follower there is arranged to be installed an operation device, for instance a handle or the like, which is arranged in force transmission connection with the follower through the torsion unit and said coupling member.

The selection for providing force transmission through the torsion unit is arranged by making use of a separate adapting member, which is installed in the spindle aperture of the selected torsion unit so that it prevents a spindle of the handle from directly connecting with the follower.

In case the coupling member includes a protrusion which is functionally connected with only one torsion unit at a time, the selection for providing force transmission through the torsion unit is arranged by arranging the said protrusion of the coupling member on the desired side of the follower.

BRIEF DESCRIPTION OF THE DRAWINGS

In the following the invention is described, by way of example only, with reference to the attached drawings, in which.

DETAILED DESCRIPTION

Figure 1:
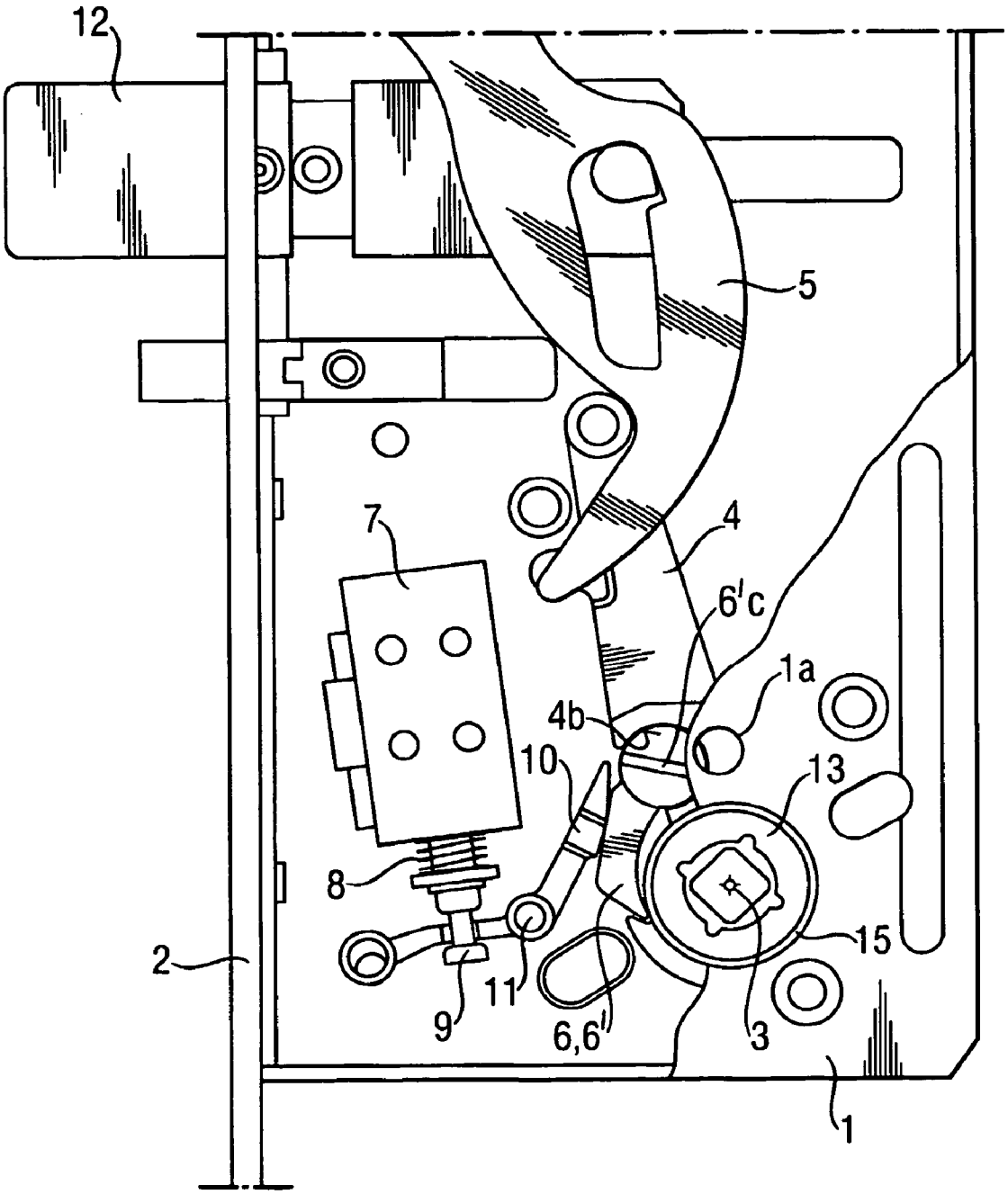
FIG. 1 shows as a view of principle a door lock according to the invention, viewed from a side, the lock case partly opened and provided with an installation arrangement according to the invention.

In the drawings the reference numeral 1 indicates a lock case of a door lock having a cover which in the figures is shown partly opened. The lock case 1 is provided with a front plate 2 through which a bolt 12 of the lock is movable. In addition the lock case 1 is provided with an operation axis 3 to which is installed a follower 4 which is turnably supported to the lock case and which in the embodiments shown acts on the bolt of the lock through a separate force transmission lever 5. Depending on the lock type, when desired, the follower can naturally be arranged to move the bolt of the lock also directly.

In practice the follower 4 can be affected from both sides of the lock case. A key operated lock mechanism or the like, which is provided with a torsion arm or a corresponding force transmission element (not shown) acting directly on the follower 4, is installed on the operation axis 3 on one side of the lock case in a way known as such. Alternatively, also a handle or the like may be installed a spindle of which acts directly on the follower 4. On the other side of the lock case a handle, a turn knob or the like is installed on the operation axis 3, a spindle of which (cf. FIG. 2) is independent on the said force transmission element of the lock mechanism or of the spindle of the handle installed on the other side of the lock so that the handle operation in question can correspondingly be controlled independently. The force transmission required by the handle operation is arranged by means of a coupling member 6,6', which has two selectable operating positions, a force transmission coupling position, in which the bolt of the lock can be moved by means of the handle, and a force transmission decoupling position, in which the bolt of the lock correspondingly cannot be affected by means of the handle.

Control of the handle operation occurs with an arrangement, which includes a solenoid 7 which moves a shaft element 9 against the force of a spring 8. Arranged on the shaft element 9 there is a lever member 10 which is turnable around a spindle 11 and by means of which is it possible to select whether or not the coupling member 6,6' is in its position connecting the force transmission.

Figure 2:
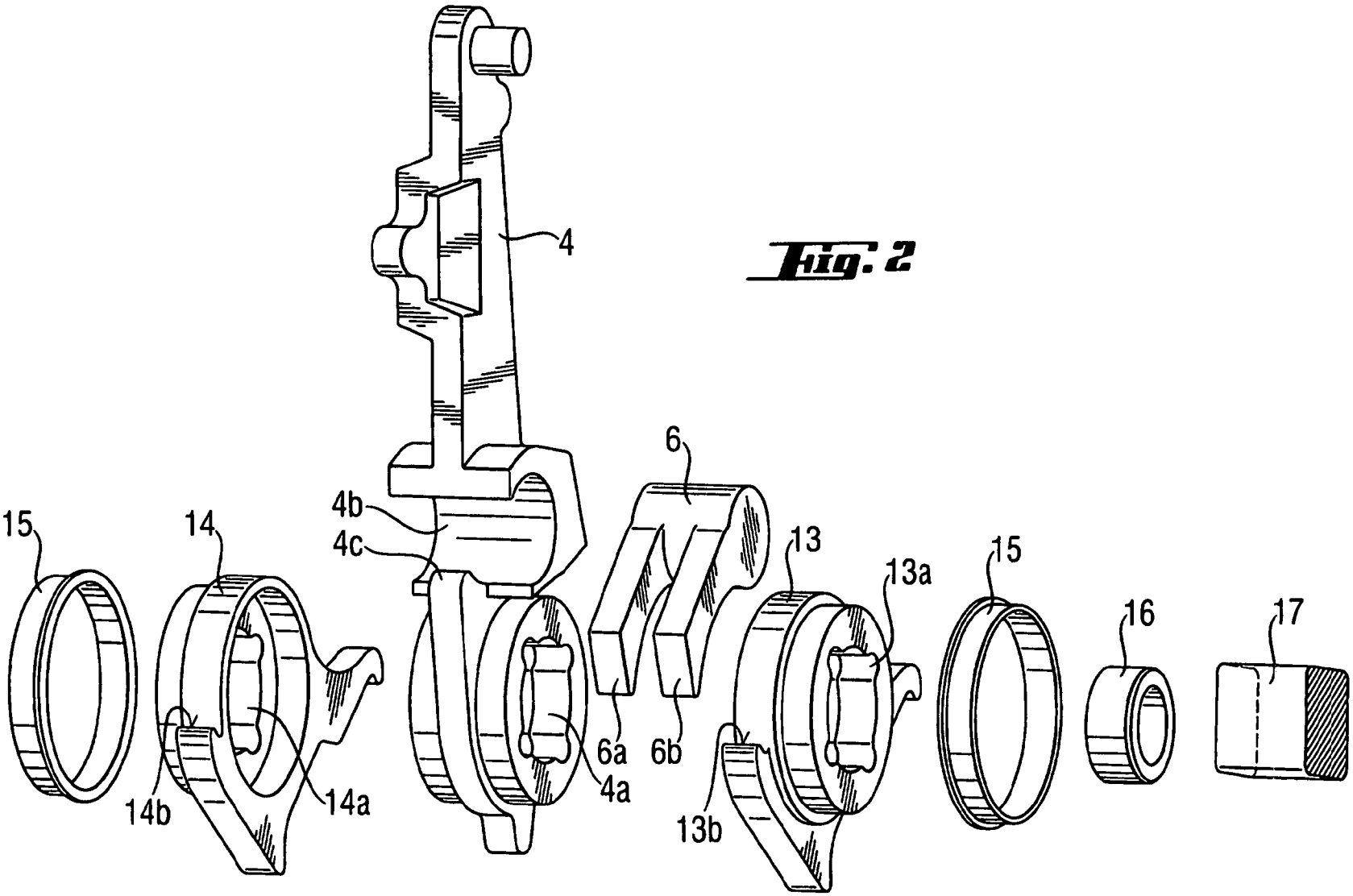
FIG. 2 shows as an exploded view an embodiment of a follower arrangement included in the installation arrangement according to the invention.

The follower arrangement of FIG. 2 is as follows. The follower 4 is provided with a spindle aperture 4*a*, which is located in the lock case at the position of the operation axis 3. Since the torsion arm associated with the key operation of the lock or the spindle of a handle to be installed on the corresponding side of the lock extends in practice to the spindle aperture 4*a* (not shown), it can always be used to directly operate the follower 4. The follower 4 includes additionally a sleeve-like element 4*b*, to which the coupling member 6 is turnably journalled. The coupling member 6 includes two protrusions 6*a* and 6*b*, which are located on either side of a protrusion 4*c* arranged in the follower. The protrusion 4*c* prevents movement of the coupling member 6 in the direction of the operation axis 3.

Figure 3B:
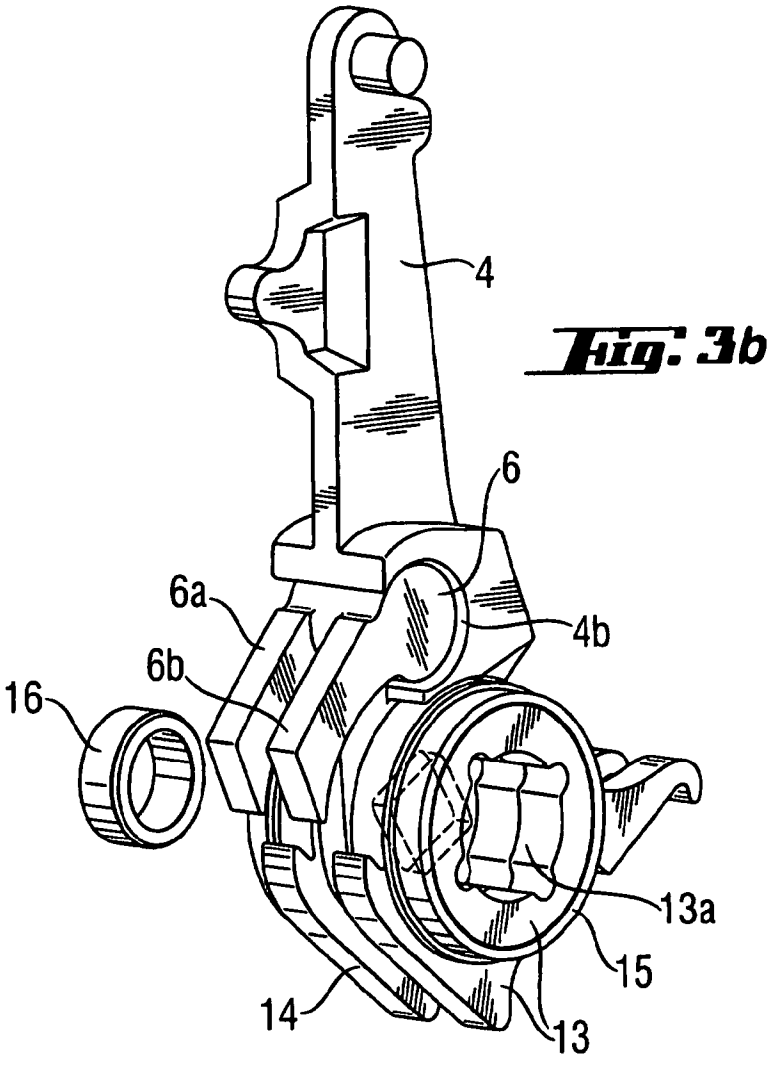
FIGS. 3*a* and 3*b* illustrate by means of the follower arrangement of FIG. 2 installation measures relating to the installation arrangement according to the invention.
Figure 3A:
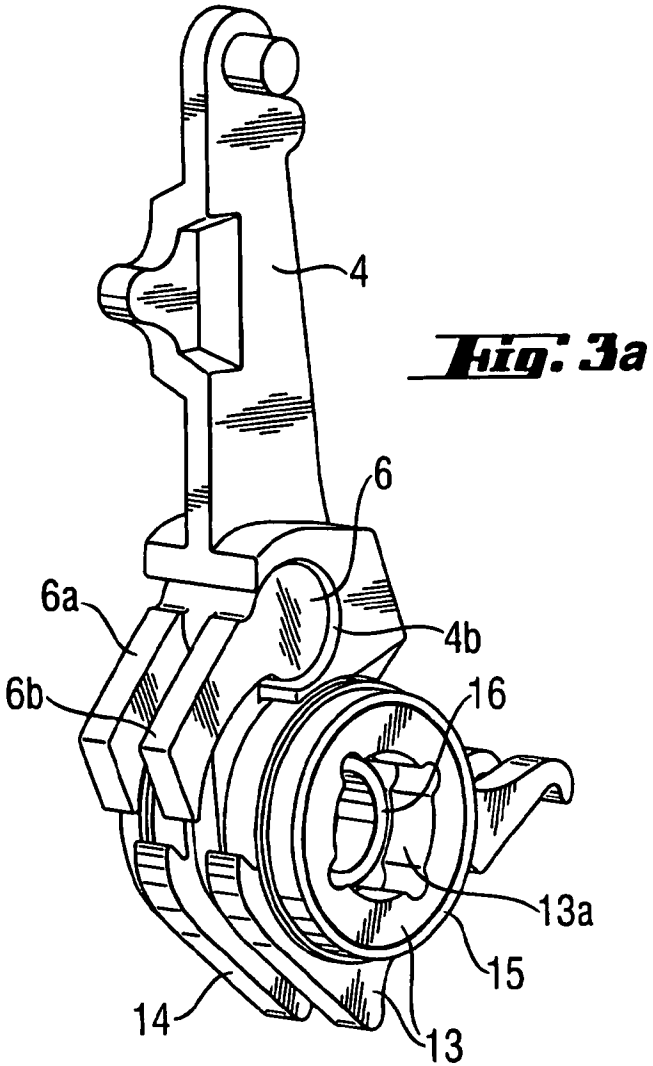

On different sides of the follower 4 there are turnably journalled torsion units 13 and 14 including spindle apertures 13*a* and 14*a* and counter surfaces 13*b* and 14*b* for the protrusions 6*a* and 6*b* of the coupling member 6. The whole follower arrangement is turnably journalled to the lock case 1 by means of bearing elements 15. The arrangement includes also an adapting member 16 by means of which the selectivity for the handle operation can be provided so that the spindle 17 of the handle extends to the spindle aperture 13*a* or alternatively to the spindle aperture 14*a* but not to the actual spindle aperture 4*a* of the follower. Hence the force transmission required for the handle operation can be coupled or decoupled under the control of the solenoid 7 on that side of the door in the spindle aperture of which the adapting member 16 is in each case installed (cf. FIGS. 3*a* and 3*b*). Since the adapting member 16 is so dimensioned that it can be inserted in the spindle aperture of the torsion units 13 and 14, if necessary it may be removed to be installed on the other side of the lock without opening the lock case 1.

Figure 4:
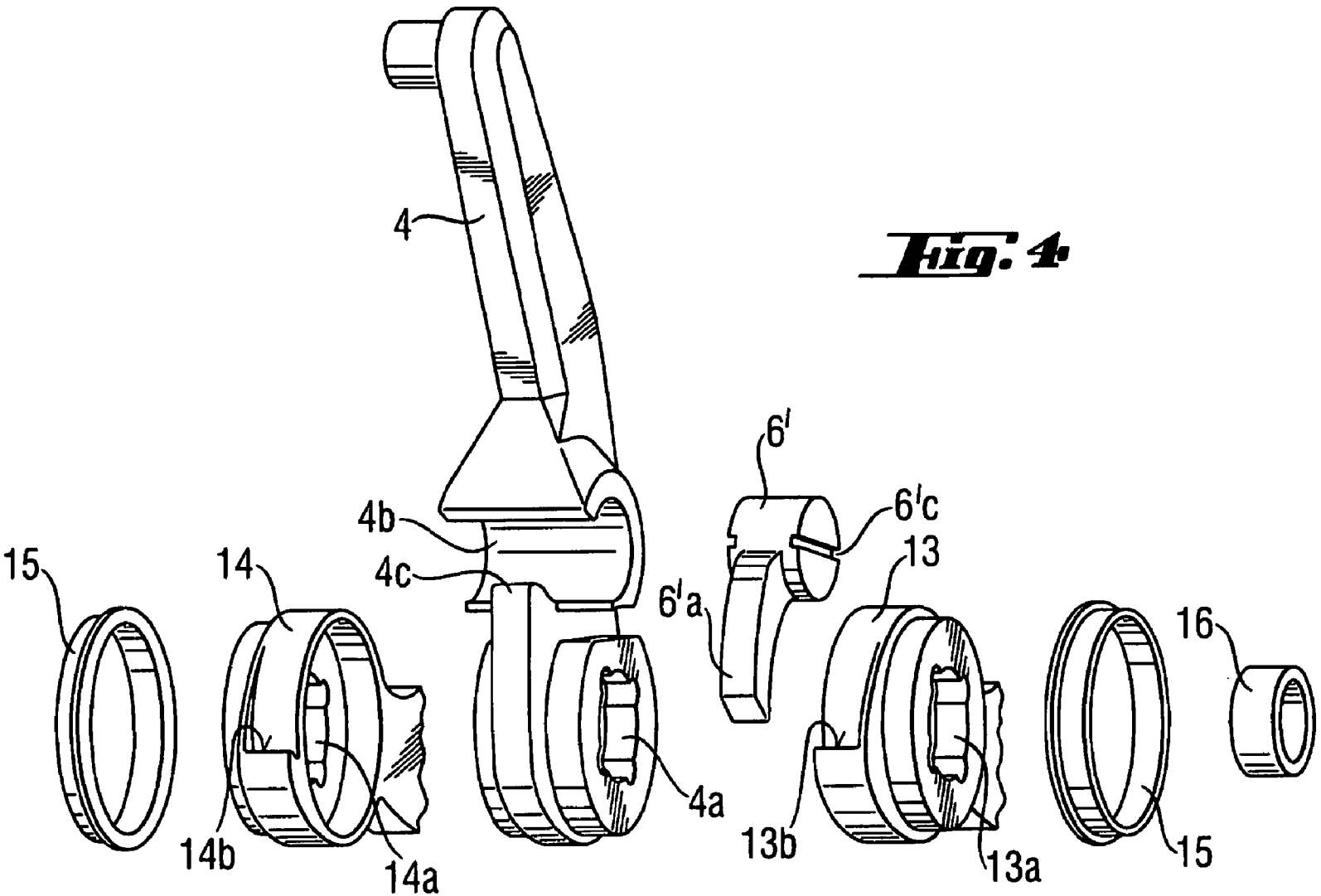
FIG. 4 shows as an exploded view another embodiment of a follower arrangement included in the installation arrangement according to the invention, FIGS. 5*a* . . . 5*d* illustrate by means of the follower arrangement of FIG. 4 installation measures relating to the installation arrangement according to the invention, FIGS. 6 . . . 8 illustrate installation measures relating to the installation arrangement of the embodiment of FIG. 4 as views corresponding to FIG. 1.

In an alternative embodiment shown in FIG. 4 the coupling member 6' includes only one protrusion 6'*a* which is movable in the direction of the axis of the sleeve-like element 4*b* so that it may optionally be installed on either one side of the protrusion 4*c* of the follower. In order to arrange for the moving operation the coupling member includes counter surfaces 6'*c* for a suitable tool, for instance a screwdriver. For other parts the embodiment of FIG. 4 is analogous with that shown in FIGS. 2, 3*a* and 3*b*. Thus, when one wishes to change the solenoid controlled handle operation from one side of the door to the other the coupling member 6' must first be moved so that its protrusion 6'*a* is positioned on the other side of the protrusion 4*c* and in addition the adapting member 16 needs to be moved on the other side of the lock.

Figures 5A, 5B, 5C, 5D:
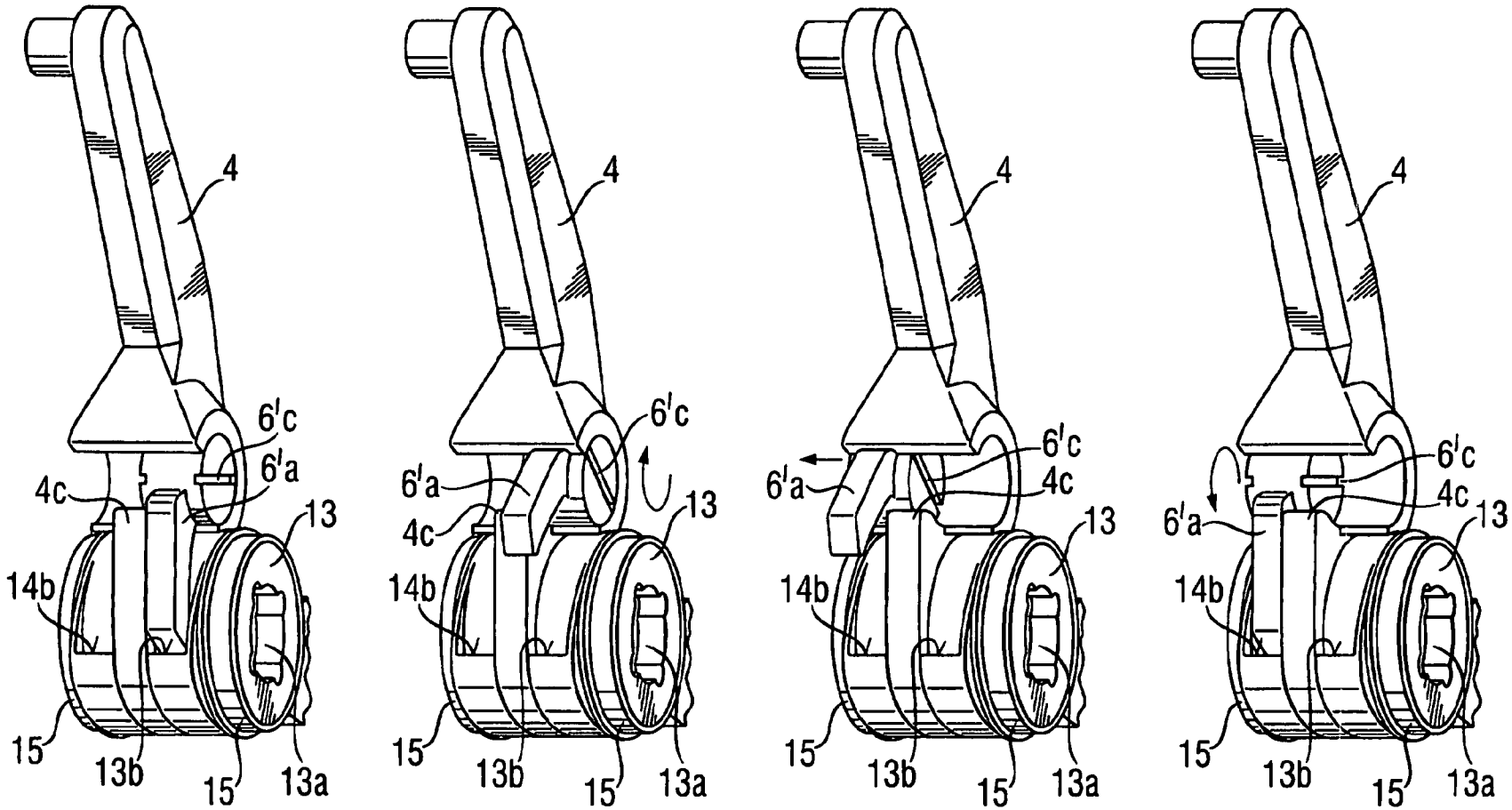

Installation measures of the coupling member 6' relating to the embodiment of FIG. 4 are illustrated with FIGS. 5*a* . . . 5*d* and 6 . . . 8. In the starting situation of FIGS. 1 and 5*a* the coupling member 6' with its protrusion 6'*a* is in contact with the counter surface 13*b* of the torsion unit 13 affected by the lever member 10, whereby a handle installed on the operation axis 3 (not shown) is in force transmission connection with the follower 4. When the lock case is installed to a door, in case it is discovered that the handle operation in this position of the coupling member 6' would be located on the wrong side of the door, the following installation measures are carried out.

Figure 6:
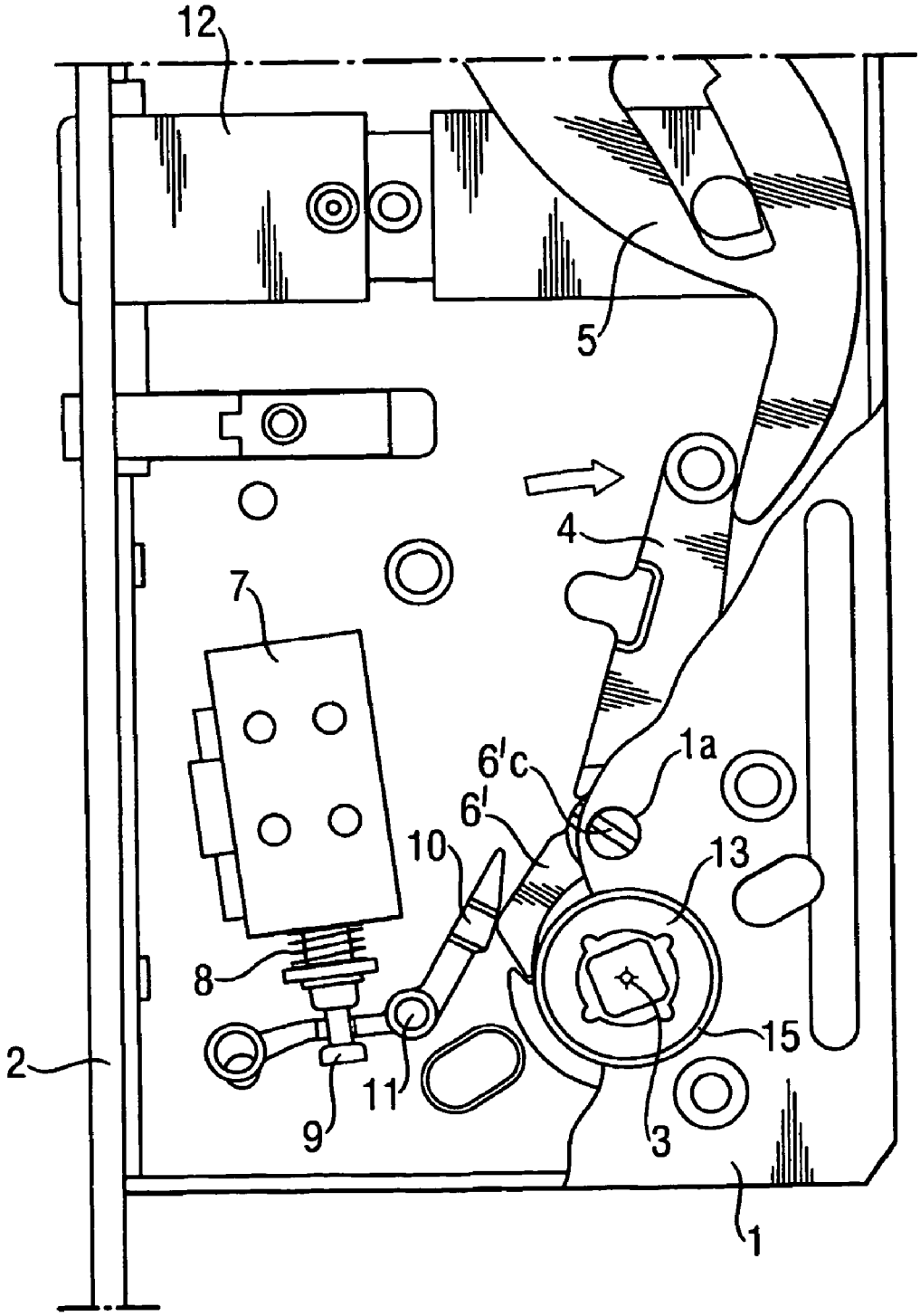
Figure 7:
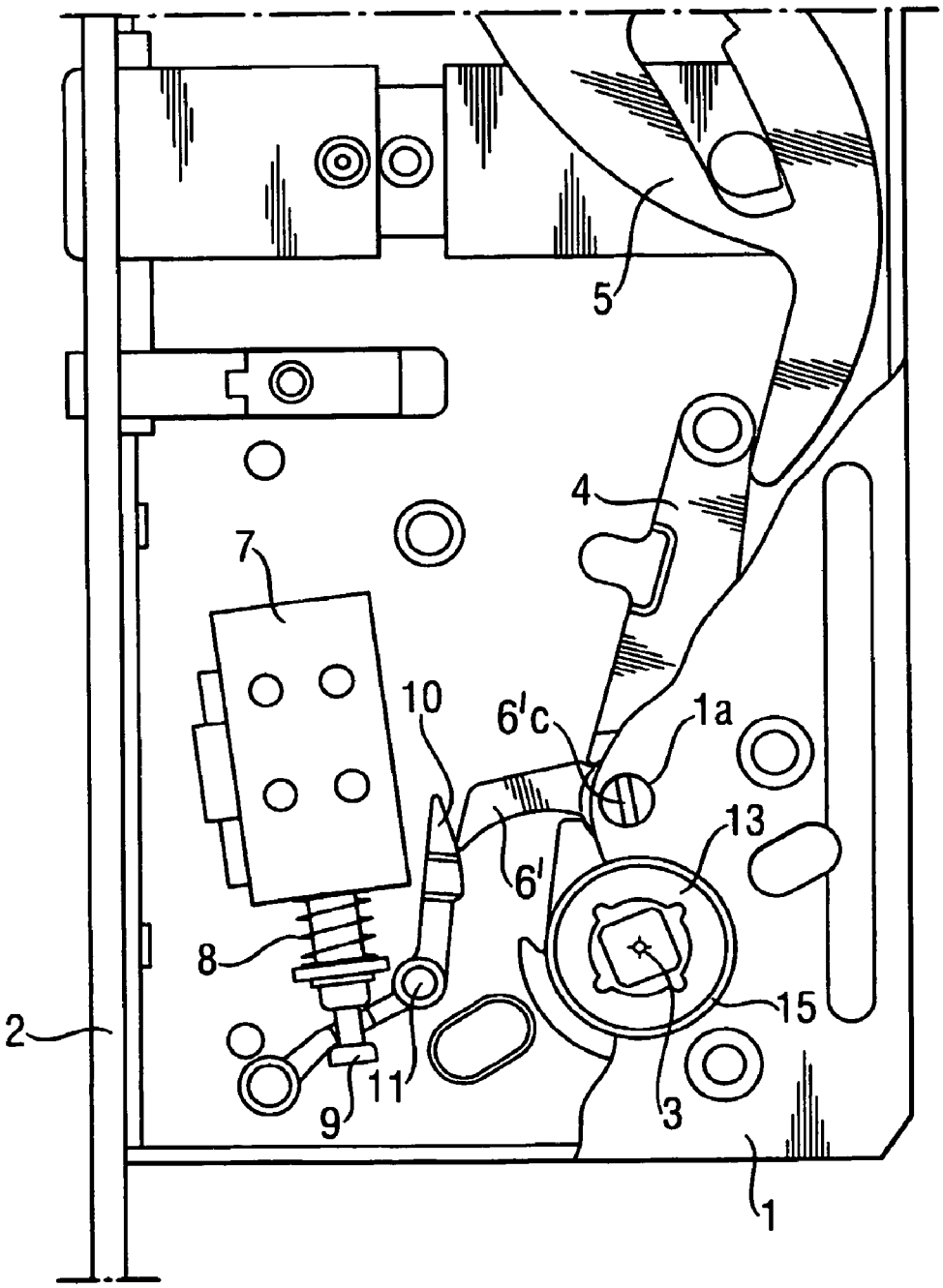
Figure 8:
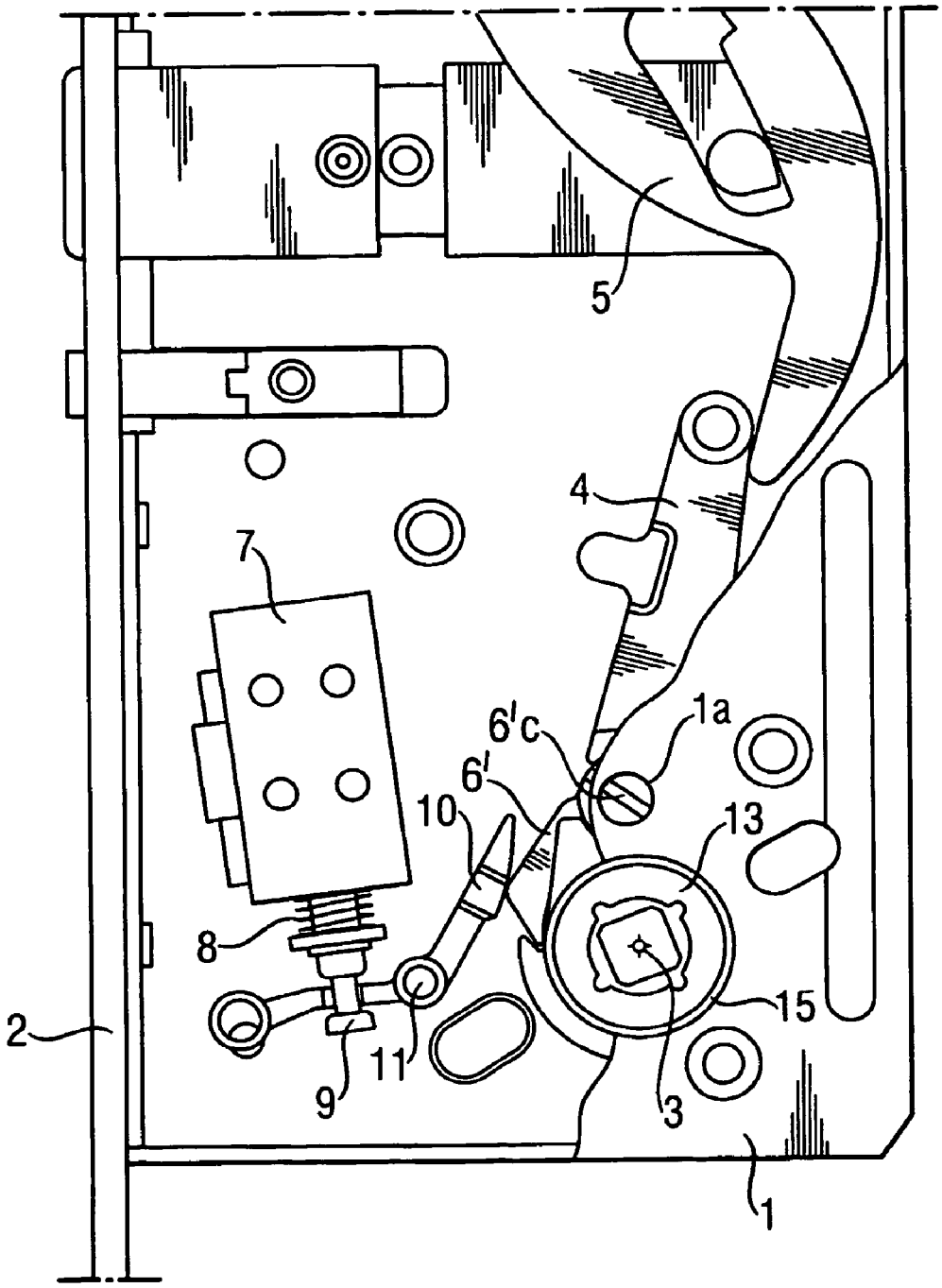

The follower 4 is turned from either one side of the lock case to the opening position of the bolt in accordance with FIG. 6. As a consequence of this the counter surfaces 6'*c* in the coupling member are located at the position of an opening 1*a* in the cover of the lock case 1. The coupling member 6' is turned with a suitable tool through the opening 1*a* by making use of the counter surfaces 6'*c* as shown in FIGS. 5*b* and 7 so that thereafter the coupling member 6' can be further pressed with the tool along the sleeve-like element 4*b* beyond the protrusion 4*c* to the position of FIG. 5*c*. In this position the coupling member 6' can be further turned by the tool into the position of FIGS. 5*d* and 8. Thereafter the follower 4 is turned back to the position of FIG. 1, whereby the coupling member 6' can again be selectively arranged, by means of the solenoid 7, into force transmission connection with the follower 4 through the counter surface 14*b* of the torsion unit 14. By these measures and by moving also the adapting member 16 from one side of the lock to the other as described above the handle operation can be changed from one side of the lock case to another as required by the installation situation of the lock case.

In accordance with the embodiment of FIG. 2, thus, both the torsion units 13 and 14 can as such be always guided, under the control of the solenoid arrangement, to be in force transmission connection with the follower by means of the protrusions 6*a* and 6*b* of the coupling member 6, whereby the location of the adapting member 16 determines on which side of the lock the handle operation can be controlled with the solenoid in the way described. In principle one could make use of the embodiment of FIG. 2 also without the adapting member 16 so that a handle with a spindle shorter than usual is installed on the operation axis 3 so that it normally extends only to the spindle aperture of the torsion unit but not to the spindle aperture of the follower.

The invention is not limited to the embodiment shown but several modifications are feasible within the scope of the attached claims.

What is claimed is:

1. A door lock comprising:

a lock case having first and second sides, a bolt, a follower acting on the bolt, a spindle, first and second torsion units installed in the lock case at opposite respective sides of the follower and turnable relative to the follower about an operating axis of the lock, each torsion unit defining a spindle aperture, and wherein the spindle can be inserted selectively either in the spindle aperture of the first torsion unit from the first side of the lock case for turning the first torsion unit or in the spindle aperture of the second torsion unit from the second side of the lock case for turning the second torsion unit, a coupling member that is movable relative to the follower to a coupling position in which the coupling member couples at least the first torsion unit to the follower for force transmission from the first torsion unit to the follower, an actuator for effecting movement of the coupling member, and an adapting member that can be installed in the spindle aperture of the first torsion unit for preventing the spindle from directly engaging the follower when the spindle is inserted in the spindle aperture of the first torsion unit, wherein the adapting member is removable from the spindle aperture of the first torsion unit and installable in the spindle aperture of the second torsion unit.

2. A door lock according to claim 1, wherein the coupling member includes first and second protrusions for engaging the first and second torsion units respectively.

3. A door lock according to claim 1, wherein the coupling member has a first installation position in which a protrusion of the coupling member can engage the first torsion unit, the coupling member has a second installation position in which the protrusion can engage the second torsion unit, and the coupling member is movable selectively either to the first installation position or to the second installation position.

4. A door lock according to claim 3, wherein the coupling member is movable parallel to the operation axis for effecting the change of installation position.

5. A door lock according to claim 3, wherein the follower includes a guiding member which normally prevents movement of the coupling member from the first installation position to the second installation position.

6. A door lock according to claim 3, wherein the coupling member includes a formation for engagement by an installation tool and the casing is formed with an opening through which the installation tool can be inserted to engage the formations for moving the coupling member from the first installation position to the second installation position.

7. A door lock according to claim 1, wherein the follower includes a sleeve-like structure for turnably journalling the coupling member.

8. A door lock according to claim 1, wherein the follower is formed with a spindle aperture, the door lock comprises a first operating device mounted at the first side of the lock case and acting on the follower through the spindle and the first torsion unit, and the lock comprises a second operating device mounted at the second side of the lock case and acting directly on the follower through the spindle aperture formed therein.

9. A door lock according to claim 1, wherein the coupling member includes a protrusion that is functionally connected with the first torsion unit and wherein the coupling member can be disengaged from the first torsion unit and engaged with the second torsion unit.

10. A door lock comprising:

a lock case having first and second sides, a bolt, a follower acting on the bolt, a spindle, first and second torsion units installed in the lock case at opposite respective sides of the follower and turnable relative to the follower about an operating axis of the lock, each torsion unit defining a spindle aperture, and wherein the spindle can be inserted selectively either in the spindle aperture of the first torsion unit from the first side of the lock case for turning the first torsion unit or in the spindle aperture of the second torsion unit from the second side of the lock case for turning the second torsion unit, a coupling member that is movable relative to the follower to a coupling position in which the coupling member couples at least the first torsion unit to the follower for force transmission from the first torsion unit to the follower, an actuator for effecting movement of the coupling member, and an adapting member that can be installed in the spindle aperture of the first torsion unit for preventing the spindle from directly engaging the follower when the spindle is inserted in the spindle aperture of the first to unit, and wherein the spindle apertures of the torsion units are configured so that they allow the adapting member to be installed in the spindle aperture of the first torsion unit and removed from the spindle aperture of the first torsion unit without removing the first torsion unit from the lock case.

* * * * *